US005441444A

United States Patent [19]

Nakajima

[11] Patent Number: 5,441,444

[45] Date of Patent: Aug. 15, 1995

[54] POLISHING MACHINE

[75] Inventor: Makoto Nakajima, Nagano, Japan

[73] Assignee: Fujikoshi Kikai Kogyo Kabushiki Kaisha, Nagano, Japan

[21] Appl. No.: 130,473

[22] Filed: Oct. 1, 1993

[30] Foreign Application Priority Data

Oct. 12, 1992 [JP] Japan ..... 4-299190

[51] Int. Cl.[6] ..... B24B 7/22

[52] U.S. Cl. ..... 451/289; 451/288; 451/388

[58] Field of Search ..... 51/131.4, 131.2, 131.5, 51/132, 129, 235, 283 R; 451/283, 388, 41, 285–289, 290

[56] References Cited

U.S. PATENT DOCUMENTS 5,081,795 1/1992 Tanaka et al. ..... 51/131.1
5,205,082 4/1993 Shendon ..... 51/129

FOREIGN PATENT DOCUMENTS 4-13567 1/1992 Japan .
0818837 5/1981 U.S.S.R. ..... 51/131.4
0891385 12/1981 U.S.S.R. ..... 51/131.4

*Primary Examiner*—Robert A. Rose
*Attorney, Agent, or Firm*—Jordan and Hamburg

[57] ABSTRACT

An object of the present invention is to provide a polishing machine having a smaller holding section. In the polishing machine of the present invention, a polishing plate polishes a wafer. A holding section has a concave section. A carrying plate, which is provided in the concave section, holds the wafer. A press mechanism for pressing the carrying plate toward the polishing plate comprises an elastic plate dividing an inner space of the concave section into an upper space, which is formed as an air tight chamber, and a lower space, and allowing the carrying plate to move in the vertical and the horizontal directions by elastic transformation, and a fluid supplying unit for supplying fluid into the upper space for pressurizing. In the polishing machine, the elastic plate is formed into a plate, so that its size in the vertical direction can be small, and the vertical size of the polishing machine also can be smaller.

11 Claims, 2 Drawing Sheets

POLISHING MACHINE

BACKGROUND OF THE INVENTION

The present invention relates to a polishing machine. More precisely, the present invention relates to a polishing machine comprising a polishing plate, whose upper face is formed as a polishing face, for polishing a wafer, whose bottom face is pressed onto the polishing face; a holding section having a concave section, whose bottom face is opened, the holding section being capable of horizontally moving toward a position above the polishing plate, vertically moving with respect thereto, and rotating in a plane parallel thereto; a carrying plate, which is provided in the concave section of the holding section, for holding the wafer on a bottom face, the carrying plate being capable of vertically moving in the concave section; and a press mechanism for pressing the carrying plate toward the polishing plate by fluid pressure.

Recently, silicon wafers on which integrated circuits are formed, have been required to have highly uniform thickness and highly plane surfaces. To satisfy these requirements, a polishing machine having a press mechanism for pressing carrying plates toward polishing plates by fluid pressure was invented. This polishing machine was disclosed in the Japanese Patent Kokai Gazette No. 4-13567. In the polishing machine disclosed in the gazette, a cylindrical metal bellows, which is capable of extending and shrinking upward and downward, is provided on an upper face of a carrying plate. Compressed air, which is one example of fluid, is supplied into the metal bellows so as to uniformly press the upper face of the carrying plate. Since air pressure is uniformly applied to the upper face thereof, a silicon wafer, which is held on a bottom face of the carrying plate, is uniformly pressed onto a polishing face (an upper face) of a polishing plate. Therefore, the silicon wafer can be polished to have highly uniform thickness and highly plane surfaces.

However, the conventional polishing machine has the following disadvantages.

The metal bellows extends downward when compressed air is supplied. Thus a holding section, which accommodates the carrying plate and the metal bellows, must be large in the vertical direction, so that the polishing machine must be larger and heavier.

Furthermore, friction between the silicon wafer and the polishing plate makes the carrying plate rotate with respect to the holding section while the silicon wafer is polished. The metal bellows is twisted by the rotation, so that stress continuously acts on the metal bellows. As a result of the stress, the bellows is likely to be severely damaged.

SUMMARY OF THE INVENTION

An object of the present invention is to provide a polishing machine having a smaller holding section. Another object of the present invention is to provide a polishing machine, which is capable of limiting the rotation of a carrying plate with respect to a holding section.

To achieve the first object, the polishing machine of the present invention comprises:

a polishing plate, whose upper face is formed as a polishing face, for polishing a wafer, whose bottom face is pressed onto the polishing face;

a holding section having a concave section, whose bottom face is opened, the holding section being capable of horizontally moving toward a position above the polishing plate, vertically moving with respect thereto, and rotating in a plane parallel thereto;

a carrying plate, which is provided in the concave section of the holding section, for holding the wafer on a bottom face, the carrying plate Being capable of vertically moving in the concave section; and a press mechanism for pressing the carrying plate toward the polishing plate by fluid pressure.

The press mechanism comprises:

an elastic plate above the carrying plate in the concave section to divide an inner space of the concave section into an upper space, which is formed as an air tight chamber, and a lower space, whose bottom face is opened, an edge section of the elastic plate being fixed to an inner face of the concave section and another section thereof being fixed to the carrying plate, whereby the elastic plate allows the carrying plate to move in the vertical and the horizontal directions by elastic transformation; and fluid supplying means for supplying fluid into the upper space.

In the polishing machine of the present invention, the elastic plate is formed into a plate, so that its size in the vertical direction can be small, and the vertical size of the polishing machine can also be smaller.

To achieve the second object, the polishing machine further comprises a device for restricting the rotation of the carrying plate and allowing the same to vertically move with respect to tile holding section.

Having the restricting means, the rotation of the carrying plate with respect to the holding section is restricted, so that stress working to the elastic plate can be reduced.

BRIEF DESCRIPTION OF TIE DRAWINGS

An embodiment of the present invention will now be described by way of an example and with reference to the accompanying drawings, in which:

FIG. 1 is a sectional view of a main part of a polishing machine of the embodiment of the present invention; and FIG. 2 is a sectional view of a driving mechanism thereof.

DETAILED DESCRIPTION OF A PREFERRED EMBODIMENT

A preferred embodiment of the present invention will now be described in detail with respect to the accompanying drawings. Note that, the polishing machine of the present embodiment is a machine for polishing silicon wafers on which integrated circuits are formed.

Figure 1:
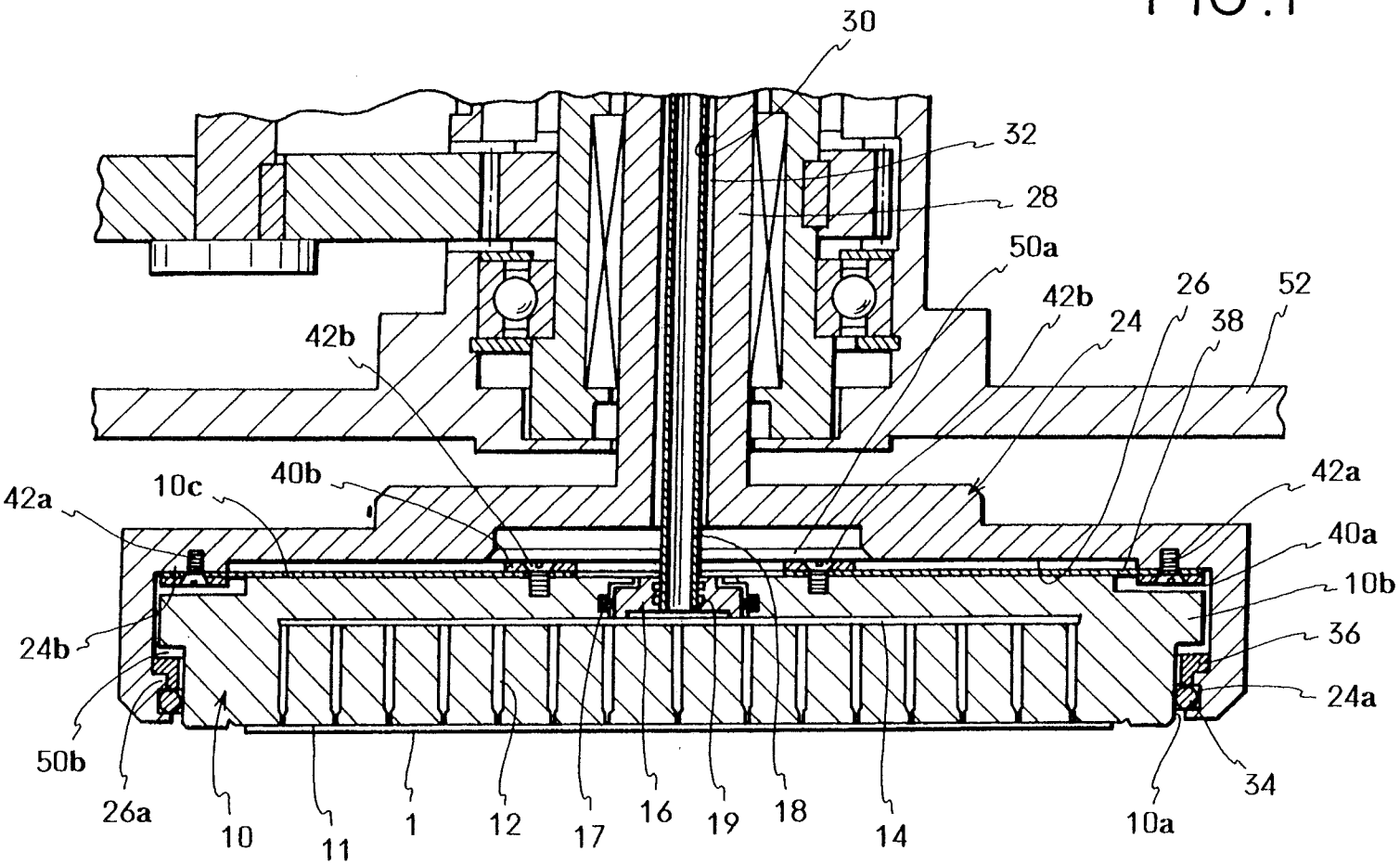
Figure 2:
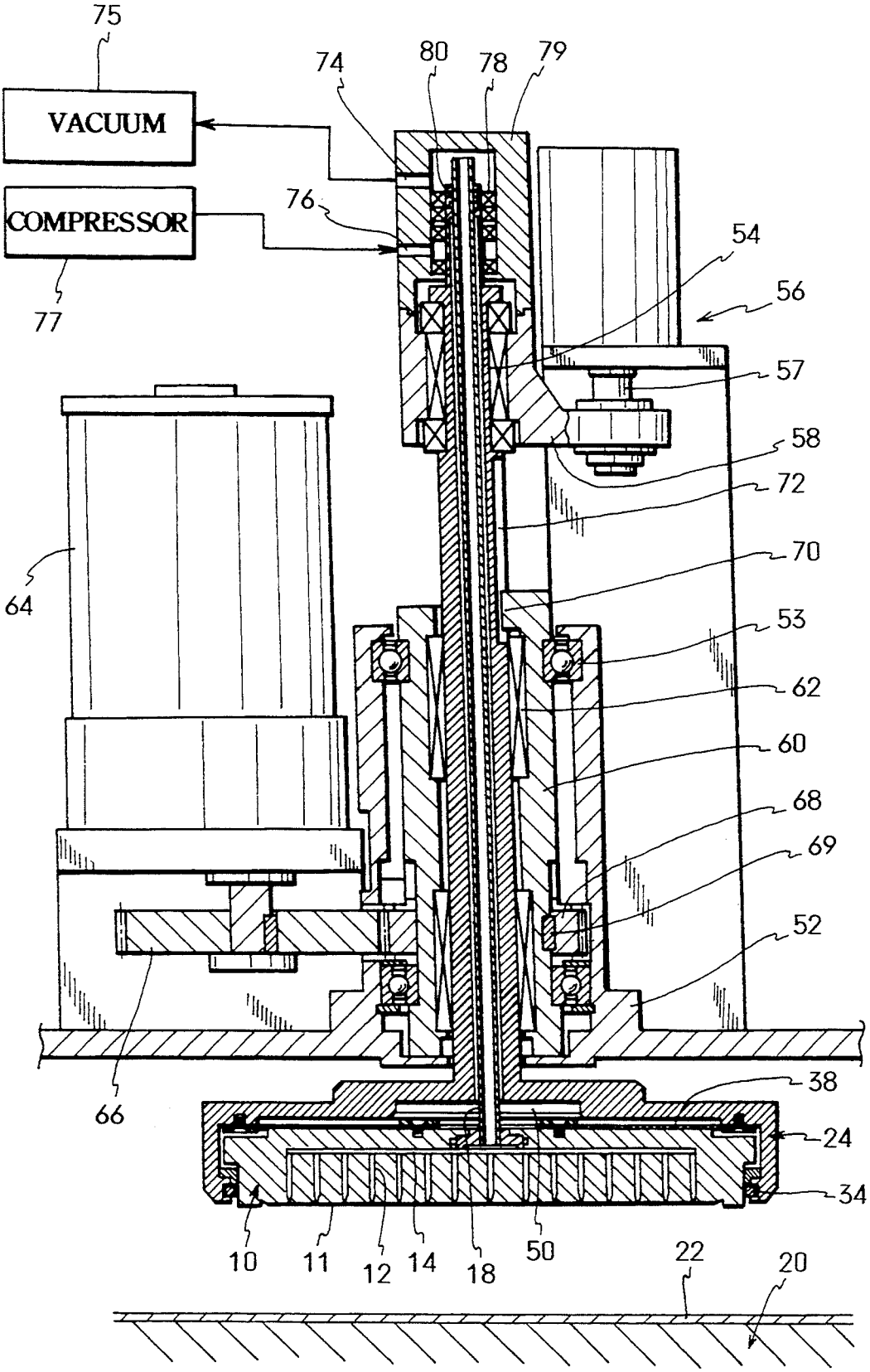

FIG. 1 is a sectional view of a main part of the polishing machine, and FIG. 2 is a sectional view of a driving mechanism thereof.

A carrying plate 10 is capable of sucking a silicon wafer 1 on a bottom face 11 so as to hold the wafer. The carrying plate 10 has a plurality of sucking holes 12, which are opened on the bottom face 11. Upper ends of the sucking holes 12 are mutually connected by a horizontal connecting space in the carrying plate 10. The connecting space is connected to a sucking pipe 18 by a connector 16. The connector 16 is fitted air-tight to the sucking pipe 18 by an 0-ring 19. And the connector 16 is fitted air-tight to the carrying plate 10 by an 0-ring 17. Thus, the connecting space 14 and the sucking pipe 18 are connected with a small clearance between the sucking pipe 18 and the carrying plate 10.

A polishing plate 20 is rotated in a horizontal plane by a driving section (not shown). A polishing cloth (not shown) is adhered on an upper face of the polishing plate 20. Thus, the upper face of the polishing plate 20 is a polishing face 22 for polishing a bottom face of the wafer 1. Slurry is supplied to the polishing face 22, and the bottom face of the wafer 1, which is held on the bottom face of the carrying plate 10, is pressed onto the polishing face 22. The wafer 1 is relatively rotated with respect to the polishing plate 20. While the wafer 1 is pressed onto the polishing plate 20, the bottom face of the wafer 1 is polished. The polishing face 22 is horizontally placed for precise polishing.

A holding section 24 is capable of moving in the vertical direction with respect to the polishing plate 20 and rotating in a plane parallel thereto. A concave section 26, whose bottom face is opened, is formed in the holding section 24. An engage section 26*a* is projected inward from an inner circumferential face 24*a* of the concave section 26. There is provided a shaft section 28, which is extended upward, at a center of an upper face of the holding section 24. A through-hole 30 is bored, in the axial direction, in the shaft section 28. The sucking pipe 18 is inserted through the through-hole 30. The inner diameter of the through-hole 30 is greater than the outer diameter of the sucking pipe 18. A space formed between an inner circumferential face of the through-hole 30 and an outer circumferential face of the sucking pipe 18 is a connecting path 32 through which compressed air, which is an example of a fluid, is introduced.

An elastic ring 34, which is an example of restricting means, restricts the rotation of the carrying plate 10 with respect to the holding section 24. The elastic ring 34 allows the carrying plate 10 to slightly move in the vertical direction with respect to the carrying plate 10. The elastic ring 34 is made of an elastic material, e.g., rubber. The elastic ring 34 is capable of contacting an outer circumferential face 10a of the carrying plate 10 and the inner circumferential face 24*a* of the concave section 26, so that the elastic ring 34 restricts the relative rotation of the carrying plate 10 and the holding section 24 by frictional force. The elastic ring 34 allows the carrying plate 10 to slightly move in the horizontal direction by its elastic transformation. Thus, the elastic ring 34 absorbs horizontal force, which is generated while the wafer 1 is polished.

Note that, the restricting means is not limited to the elastic ring 34. For example, a mechanism having a vertical groove, which is grooved on the outer circumferential face 10*a* of the carrying-plate 10, and a pin, which is pierced through the holding section from the outer circumferential face toward the carrying plate 10 and whose front end fits in the vertical groove, may be used as the restricting means. In this mechanism, since the front end of the pin is in the vertical groove, the rotation of the carrying plate 10 with respect to the holding section 24 is restricted; the vertical movement of the carrying plate 10 with respect to the holding section 24 is allowed.

A ring stopper 36 is engaged with the engage section 26*a* in the concave section 26. The ring stopper 36 is capable of contacting a bottom face of a flange section 10*b* and the outer circumferential face 10*a* of the carrying plate 10. Therefore, the ring stopper 36 restricts the horizontal and vertical movement of the carrying plate 10 in the predetermined range, and prevents the carrying plate 10 from falling down from the concave section 26. Note that, the ring stopper 36 is made of a soft material, e.g., plastic, which is softer than a material forming the carrying plate 10, so as not to damage the carrying plate 10.

An elastic plate 38 is made of an elastic material, e.g., rubber, and formed into a thin donut plate. The elastic plate 38 is provided above the carrying plate 10 and in the concave section 26 of the holding section 24. The elastic plate 38 divides the inner space of the concave section 26 into an upper space 50*a*, which is formed as an air tight chamber, and a lower space 50*b*, whose bottom face is opened. The elastic plate 38 is fixed to an inner upper face of the concave section 26 and an upper end face 10*c* of the carrying plate 10. If no force acts on the elastic plate 38, the elastic plate 38 is parallel to the polishing plate 20 (the polishing face 22). The elastic plate 38 hangs the carrying plate 10, and allows the carrying plate 10 to slightly move in the vertical and the horizontal directions by its elastic transformation. An outer edge section of the elastic plate 38 is fixed to a step section 24*b* formed in the inner upper face of the concave section 26. The outer edge section of the elastic plate 38 is pressed air-tight onto the inner upper face of the concave section 26 by a ring plate 40*a* and fixed by bolts 42*a*. On the other hand, an inner edge section of the elastic plate 38 is pressed air-tight onto the upper end face 10*c* of the carrying plate 10 by a ring plate 40*b* and fixed by bolts 42*b*.

Note that, in the present embodiment, an outer edge of an upper end face 10*c* of the carrying plate 38, which is capable of contact with the elastic plate 38, lines up with an outer side of an outer edge of the wafer 1, which has been held by the carrying plate 10. With this structure, an upper face of the wafer 1 is uniformly pressed by the carrying plate 10. The upper space 50*a* is connected to the connecting path 32 through which compressed air is introduced. When the bottom face of the wafer 1 is pressed onto the polishing face 22 of the polishing plate 20 and compressed air is introduced into the upper space 50*a* via the connecting path 32, the bottom face of the wafer 1 is, as described above, uniformly pressed onto the polishing face 22. The compressed air acts as a fluid to create pressure, so the upper end face 10*c* of the carrying plate 10 can be quickly and uniformly pressed.

A base member 52 is horizontally moved by a driving section (not shown). The base member 52 is capable of reciprocally moving the holding section 24 between a position above the polishing plate 20 and a position shifted therefrom. While the holding section is above the polishing plate 20, the wafer 1, which has been held by the carrying plate 10, can be pressed onto the polishing face 22 of the polishing plate 20 for polishing. The base member 52 is capable of rotatably holding the holding section 24.

An engage section 54 is provided at upper end section of the shaft section 28 of the holding section 24. An outer diameter of the engage section 54 is smaller than that of other parts of the shaft section 28. The engage section 54 is rotatably held by an arm 58, which is fixed to a rod 57 of a cylinder unit 56. With this structure, the holding section 24 is suspended by the cylinder unit 56. The shaft section 28 of the holding section 24 is pierced through a rotor 60, which is rotatable with respect to the base member 52, with thrust bearings 62. Thus, the holding section 24 can be vertically moved with respect to the base member 52. A stroke of the vertical movement of the holding section 24 is defined by a stroke of the rod 57 of the cylinder unit 56.

A motor 64 rotates the rotor 60 via gears 66 and 68. The rotor 60 is integrated with the gear 68 by a key 69. The rotor 60 is rotatable with respect to the base member 52 by ball bearings 53.

A key section 70 is integrated with the rotor 60 and engaged with a key groove 72, which is grooved in the shaft section 28. By engaging with the key groove 72, the holding section 24 can be rotated together with the rotor 60. Note that, since the key groove 72 is grooved long in the axial direction of the shaft section 28, even if the holding section 24 is vertically moved by the cylinder unit 56, the key section 70 can be always engaged with the key groove 72.

An air-port 74 will be connected to a vacuum generator 75, which makes the sucking holes 12 have negative pressure.

An air-port 76 will be connected to a compressor 77, which is an example of a fluid supplying means and which supplies the compressed air into the upper space 50*a* divided by the elastic plate 38. Therefore, a press mechanism for pressing the carrying plate 10 toward the polishing plate 10 by fluid pressure is constituted by the elastic plate 38 and the compressor 77.

Sealing members 78 make an air-tight seal between a case section 79 and the shaft section 28 so as to connect the air-port 74 and the sucking pipe 18 and to connect the air-port 76 and the connecting path 32.

Note that, O-rings 80 make an air-tight seal between the shaft section 28 and the sucking pipe 18.

Successively, the action of the polishing machine will be explained.

Firstly, the pressure in connecting space 14 and the sucking holes 12 is rendered negative by the vacuum generator 75, which is connected to the sucking pipe 18. As a result of the negative pressure, the wafer 1 is sucked and held on the bottom face of the carrying plate 10. Next, the base member 52 is moved so as to convey the holding section to the position above the polishing plate 20 together with the wafer 1. Then the holding section 24 is moved downward by the cylinder unit 56 for contacting the bottom face of the wafer 1 with the polishing face 22 of the polishing plate 20.

Next, the compressed air from the compressor 77 is introduced into the upper space 50*a* so as to press the bottom face of the wafer 1 onto the polishing face 22 of the polishing plate 20. At that time, since the compressed air acts as a fluid to create pressure, the upper end face 10*c* of the carrying plate 10 is uniformly pressed by the compressed air and as a result, the bottom face of the wafer 1 is also uniformly pressed onto the polishing face 22. Even if the polishing plate 20 (the polishing face 22) is inclined with respect to the horizontal plane, the whole bottom face of the wafer 1 is quickly and uniformly pressed thereonto.

The bottom face of the wafer 1 is polished by supplying slurry to the polishing face 22 and rotating the polishing plate 20 and the holding section 24 while the wafer 1 is pressed onto the polishing face 22.

The polishing machine of the present embodiment has the following advantages:

(1) Since the elastic plate 38 is formed into a thin plate, the vertical size of the holding section 24, in which the elastic plate 38 is accommodated, can be smaller, so that the polishing machine also can be small. Especially, the elastic plate 38 is horizontal or parallel to the polishing plate 20, so the vertical size can be smaller;

(2) The outer edge of the upper end face 10*c* of the carrying plate 38 lines up with the outer side of the outer edge of the wafer 1, so that the upper face of the wafer 1 is uniformly pressed;

(3) The restricting means, e.g., the elastic ring 34, restricts the rotation of the carrying plate 10 with respect to the holding section 24, so that stress acting on the elastic plate 38 can be reduced. In other words, damage to the elastic plate 38 caused by stress can be prevented ; and (4) The vertical size or the capacity of the upper space 50*a* is very small, the amount of the compressed air to be introduced may be small. Therefore, pressing the wafer 1 can be easily executed in a short period of time.

In the above described embodiment, compressed air is used as the fluid for pressing the wafer 1, with the carrying plate 10, toward the polishing plate 20. Oil can be used instead of the compressed air. In this case, an oil pump is used as the fluid supplying means.

The invention may be embodied in other specific forms without departing from the spirit or essential characteristics thereof. The present embodiment is therefore, to be considered in all respects as illustrative and not restrictive, the scope of the invention being indicated by the appended claims rather than by the foregoing description and all changes which come within the meaning and range of equivalency of the claims are, therefore, intended to be embraced therein.

What is claimed is:

1. A polishing machine, comprising:

a polishing plate, whose upper face is formed as a polishing face, for polishing a wafer, whose bottom face is pressed onto the polishing face;

a holding section having a concave section, whose bottom face is open, said holding section being capable of horizontally moving toward a position above said polishing plate, vertically moving with respect thereto, and rotating in a plane parallel thereto;

a carrying plate, which is provided in the concave section of said holding section, for holding said wafer on a bottom face, said carrying plate being capable of vertically moving in the concave section, said carrying plate having a circumferential step section formed in an upper outer edge portion of said carrying plate; and a press mechanism for pressing said carrying plate toward said polishing plate by fluid pressure, said press mechanism comprises:

an elastic plate being provided above said carrying plate in the concave section to divide an inner space of the concave section into an upper space, which is formed as an air tight chamber, and a lower space, whose bottom face is open, an edge section of said elastic plate being fixed to an inner upper face of the concave section by a fixing member provided in a space between the inner upper face of the concave section and a horizontal portion of the circumferential step section of said carrying plate, and another section of said elastic plate being fixed to said carrying plate, whereby said elastic plate allows said carrying plate to move in the vertical and the horizontal directions by elastic transformation, said elastic plate being parallel to said polishing plate when no force is applied to said elastic plate.

2. The polishing machine according to claim 1, wherein an outer edge of an upper end face of said carrying plate, which is capable of contact with said elastic plate, lines up with an outer side of an outer edge of said wafer, which has been held by said carrying plate.

3. The polishing machine according to claim 1, further comprising restricting means for restricting rotation of said carrying plate and allowing said carrying plate to vertically move with respect to said holding section.

4. The polishing machine according to claim 3, wherein said restricting means is an elastic ring provided between an outer circumferential face of said carrying plate and an inner circumferential face of the concave section of the holding section.

5. The polishing machine: according to claim 1, further comprising a fluid supplying means for supplying fluid to the upper space formed by the elastic plate, whereby the bottom face of the wafer is pressed onto the polishing face.

6. The polishing machine according to claim 1, further comprising means for creating negative pressure in said carrying plate for holding said wafer on said carrying plate.

7. A polishing machine, comprising:

a polishing plate, whose upper face is formed as a polishing face, for polishing a wafer, whose bottom face is pressed onto the polishing face;

a holding section having a concave section, whose bottom face is open, said holding section being capable of horizontally moving toward a position above said polishing plate, vertically moving with respect thereto, and rotating in a plane parallel thereto;

a carrying plate, which is provided in the concave section of said holding section, for holding said wafer on a bottom face, said carrying plate being capable of vertically moving in the concave section;

means for creating negative pressure in said carrying plate for holding said wafer on said carrying plate; and a press mechanism for pressing said carrying plate toward said polishing plate by fluid pressure, said press mechanism comprises:

an elastic plate, being provided above said carrying plate in the concave section to divide an inner space of the concave section into an upper space, which is formed as an air tight chamber, and a lower space, whose bottom face is open, an edge section of said elastic plate being fixed to an inner face of the concave section and another section thereof being fixed to said carrying plate, whereby said elastic plate allows said carrying plate to move in the vertical and the horizontal directions by elastic transformation, said elastic plate being parallel to said polishing plate when no force is applied to said elastic plate.

8. The polishing machine according to claim 7, wherein an outer edge of an upper end face of said carrying plate, which is capable of contact with said elastic plate, lines up with an outer side of an outer edge of said wafer, which has been held by said carrying plate.

9. The polishing machine according to claim 7, further comprising restricting means for restricting rotation of said carrying plate and allowing said carrying plate to vertically move with respect to said holding section.

10. The polishing machine according to claim 7, wherein said restricting means is an elastic ring provided between an outer circumferential face of said carrying plate and an inner circumferential face of the concave section of the holding section.

11. The polishing machine according to claim 7, further comprising a fluid supplying means for supplying fluid to the upper space formed by the elastic plate, whereby the bottom face of the wafer is pressed onto the polishing face.

* * * * *